US006945544B2

(12) United States Patent
Feurer et al.

(10) Patent No.: US 6,945,544 B2
(45) Date of Patent: Sep. 20, 2005

(54) BOOT RETAINING DEVICE ON A SLIDING-TYPE SNOW BOARD

(75) Inventors: Christian Feurer, Grenoble (FR); Jean-Marc Pascal, Voreppe (FR)

(73) Assignee: Emery SA, Fontanil le Cornillon (FR)

( * ) Notice: Subject to any disclaimer, the term of this patent is extended or adjusted under 35 U.S.C. 154(b) by 54 days.

(21) Appl. No.: 10/346,222

(22) Filed: Jan. 17, 2003

(65) Prior Publication Data

US 2003/0184031 A1 Oct. 2, 2003

(30) Foreign Application Priority Data

Jan. 18, 2002 (FR) ..... 02 00721
Mar. 3, 2002 (FR) ..... 02 03982

(51) Int. Cl.[7] ..... A63C 9/00

(52) U.S. Cl. ..... 280/14.22; 280/14.24; 280/633

(58) Field of Search ..... 280/14.22, 14.24, 280/618, 613, 624, 625, 626, 629, 630, 633, 634

(56) References Cited

U.S. PATENT DOCUMENTS

| | | | | | |
|---|---|---|---|---|---|
| 2,955,300 | A | * | 10/1960 | Swan et al. | 441/68 |
| 5,044,656 | A | * | 9/1991 | Peyre | 280/618 |
| 5,188,386 | A | * | 2/1993 | Schweizer | 280/607 |
| 5,261,689 | A | * | 11/1993 | Carpenter et al. | 280/618 |
| 5,380,031 | A | * | 1/1995 | Vitali et al. | 280/611 |
| 5,577,755 | A | | 11/1996 | Metzger et al. | 280/607 |
| 5,791,678 | A | | 8/1998 | Perlman | |
| 5,876,045 | A | * | 3/1999 | Acuna, Jr. | 280/14.24 |
| 5,947,508 | A | * | 9/1999 | Graf et al. | 280/616 |
| 5,984,325 | A | * | 11/1999 | Acuna | 280/14.24 |
| 6,007,085 | A | | 12/1999 | Rigal et al. | 280/607 |
| 6,068,283 | A | | 5/2000 | Couderc et al. | 280/618 |
| 6,196,569 | B1 | * | 3/2001 | Berger et al. | 280/607 |
| 6,491,310 | B1 | * | 12/2002 | Work | 280/14.24 |
| 6,663,138 | B1 | * | 12/2003 | Zanatta et al. | 280/613 |
| 6,676,152 | B2 | * | 1/2004 | Gonthier | 280/623 |
| 2003/0011171 | A1 | * | 1/2003 | Battistella | |

FOREIGN PATENT DOCUMENTS

| | | |
|---|---|---|
| DE | G 94 16 208.5 | 10/1994 |
| EP | 0 351 298 A2 | 7/1989 |
| EP | 0 351 298 A3 | 7/1989 |
| EP | 823268 A1 | 2/1998 |
| EP | 838249 A1 | 4/1998 |
| EP | 106215 A2 | 6/2001 |
| EP | 1 108452 A1 | 6/2001 |
| FR | 2726480 | 12/1995 |
| FR | 2742997 | 1/1996 |
| FR | 2752169 | 8/1996 |
| FR | 2755029 | 10/1996 |
| FR | 2736842 | 1/1997 |
| FR | 2743306 | 7/1997 |
| WO | WO/97/31688 | 2/1997 |

* cited by examiner

*Primary Examiner*—Christopher P. Ellis
*Assistant Examiner*—Christopher Bottorff
(74) *Attorney, Agent, or Firm*—Fay, Sharpe, Fagan, Minnich & McKee, LLP

(57) ABSTRACT

A boot retaining device for use with a snowboard includes a plate equipped with straps for retaining an associated boot. A pivot body is located at a central region of the plate. The pivot body retains the plate on the board and includes a central screw or central nut. A support base is attached to the board. The support base includes threading configured for threadably engaging the central screw or nut of the pivot body. The pivot body includes a downwardly open housing which receives the support base. The threaded stem of the central screw or the threaded portion of the central nut projects downward into the housing. A length of the threaded stem of the central screw or the threaded portion of the central nut is less than or equal to a depth of the housing.

12 Claims, 9 Drawing Sheets

BOOT RETAINING DEVICE ON A SLIDING-TYPE SNOW BOARD

The present invention concerns a boot retaining device on a snow board intended, more particularly for surfing practice, also called snow-boarding. It concerns, more particularly its means of fixation at the surfboard and its control in angular position.

There are different kinds of snow-boards, i.e. alpine skis, cross-country skis, jumping skis, hot-dogging or free-styling skis.

But there are also snow-boards which are called surfing boards whose width is sufficiently wide so as to be able of retaining the two boots of the skier in an angular position, i.e. in slanted position relative to the general plane of symmetry of the board, with the front extremity of the boots facing toward the right for a right-handed skier, or toward the left for a left-handed skier. Consequently, one of the feet is arranged in front of the other foot, with each of the boots being also in an angular position different from the other boot. It should also be noted that each user wants to be able to control the angular position of his boots, either in definitive fashion or in a manner so that said control can be modified.

Thus, the boots of the user are fixed to the surf-board, for example, to a plate which is either fixed in non-regulatable fashion to the ski in the selected angular position, or mounted on a pivot comprising retention means which permit regulation of the angular position by rotation around a vertical axis and by immobilizing said plate by locking.

A device disclosed by French Patent No. 2 743 306 is known, for example, or even No. 2 726 480, No. 2 755 029, No. 2 752 169, WO 97/31688, No. 2 736 842 or even European Patent Application EP 0 351 298 or German Patent Application G 9 416 208.

All these prior art devices, are however not very practical and frequently quite unreliable.

The present invention proposes a new device, which is particularly simple, easy to implement and reliable.

Thus, according to the invention, the retention device of a boot on a surfing board of the type comprising

- a plate equipped with boot retention means
- a pivoting body located in the central zone of the plate, retaining same at least vertically, said pivot comprising a central screw or a central nut,
- a base fixed to the surf-board, comprising threading intended to cooperate with the central screw or the central nut of the pivot, and characterized in that the pivot body includes a central encasement housing, open toward the bottom, in which is engaged the base, and in that the threaded pin of the central screw or the threaded portion of the central nut protrudes in downward direction in the central encasement housing, while the length of the threaded pin of the central screw or the threaded portion of the threaded nut is equal to or less than the depth of the encasement housing.

According to a complementary characteristic, the plate comprises a central hole, intended to receive and cooperate with the pivot, said central hole comprising, additionally, a peripheral edge, whose transverse surface turned in upward direction, comprises circular teeth, formed by a succession of radial projections and cavities, intended to cooperate with circular teeth intended to cooperate with a succession of radial projections and cavities realized on the lower transverse surface of a peripheral rim realized on the body of the pivot.

According to another characteristic, the central screw is captively retained by the pivot, thanks to an elastic retaining piece.

It should be added that the base has a thickness of more than 5 mm and/or in excess of half of the thickness of the body of the pivot.

According to a preferred embodiment, the general shape of the base is square, with each of the angles presenting a projection extending in diagonal fashion, while the encasement housing has a complementary shape, blocking the body of the pivot from displacement during translation and during rotation.

It should also be noted that according to said same embodiment, each of the diagonal projections comprises a hole intended to receive the surf-board fixation screws.

According to a variation, the threaded pin is on the base, while the pivot body comprises a threaded nut.

It is clear that thanks to the means of the invention, the personnel who assembles the bindings can prepare surf-boards with the support base of the invention and is able to attach different types of plates and does so by choosing the specified plate.

The invention also concerns a surf-board equipped with a support base.

Other characteristics and benefits of the invention are apparent from the description which follows with respect to the attached drawings, and which are provided by way of example only but are not limited thereto.

FIG. 8 is a view of the un-mounted elements.

FIG. 9 is a view at the start of positioning the plate with its pivot.

FIG. 10 is a view during fixation of the pivot on the support base.

FIG. 11 is a view in mounted position.

Figure 2:
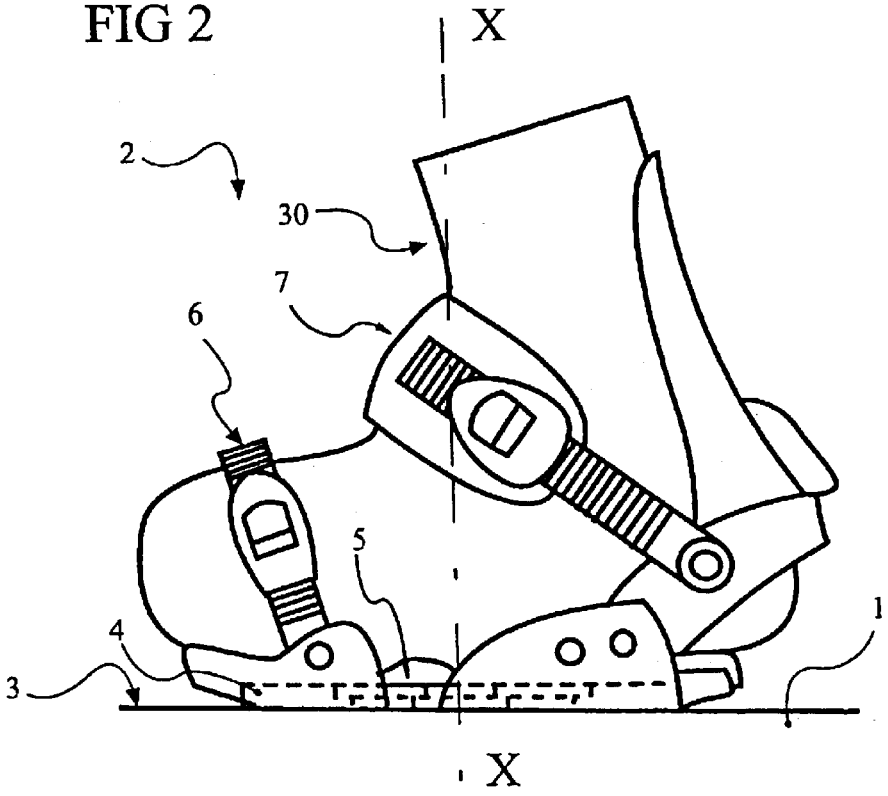
FIG. 2 is a lateral view of the retention device with boot.
Figure 3:
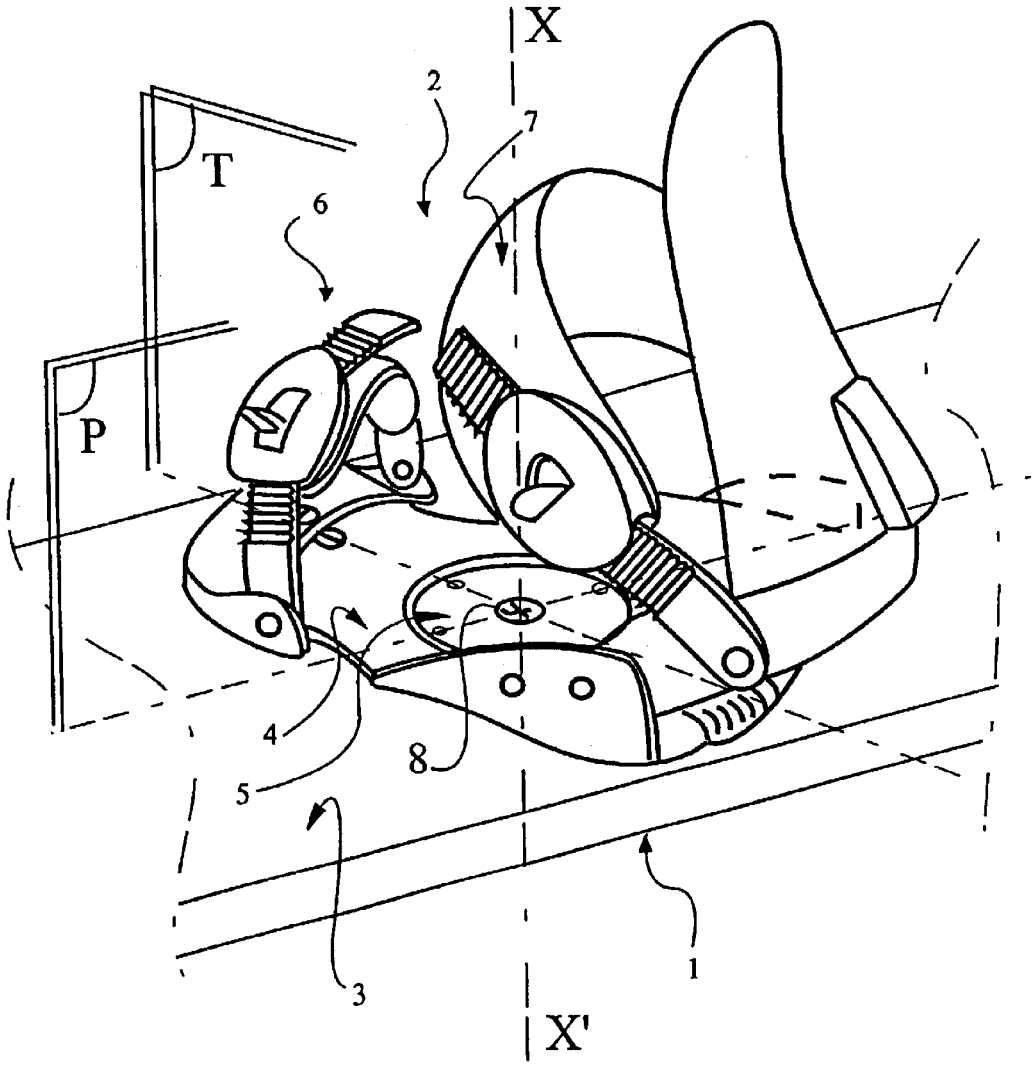
FIG. 3 is a perspective view of one of the boot retention devices, but without said boot.
Figure 4:
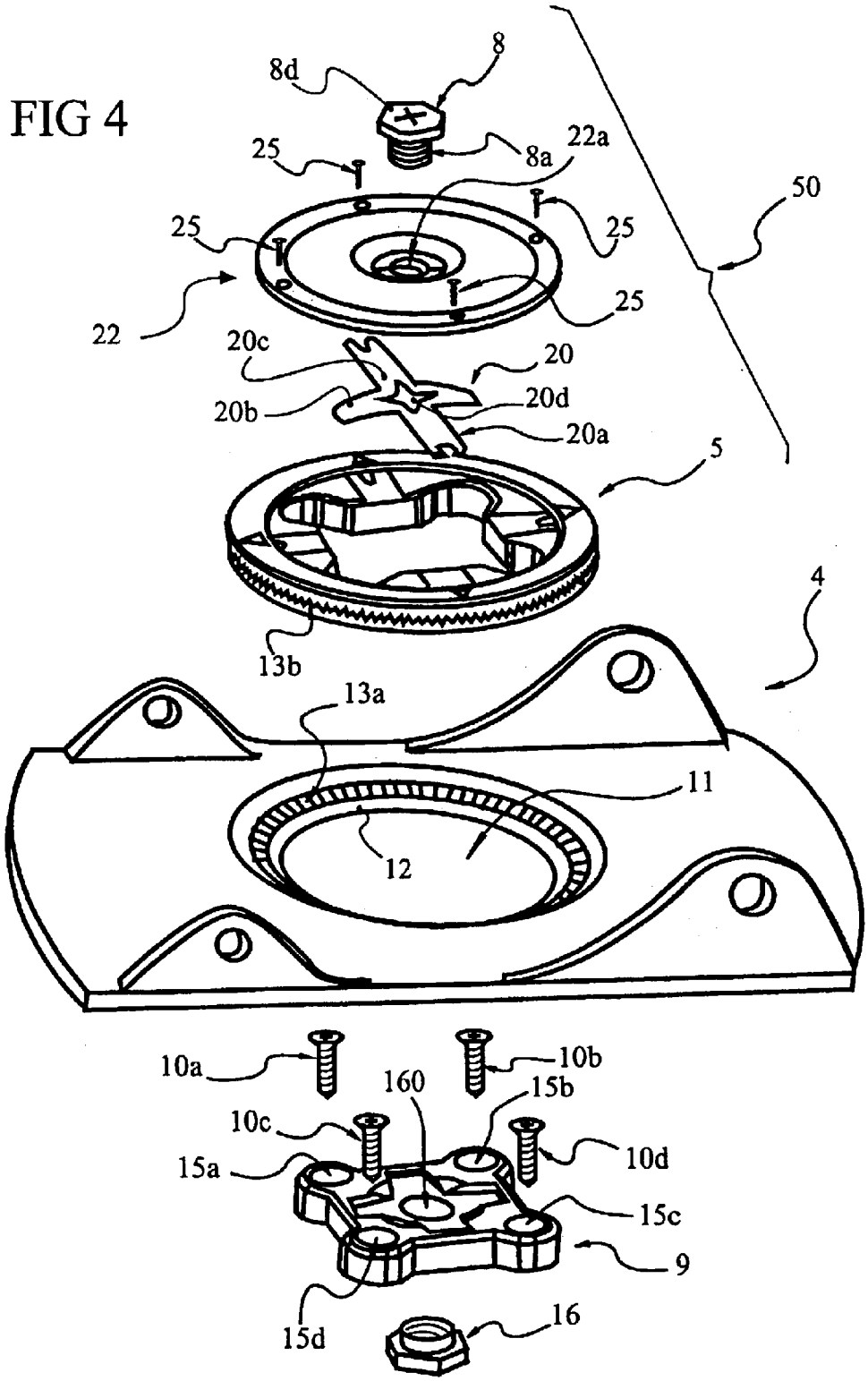
FIG. 4 is an exploded view in perspective of the plate retention means to the surf-board, representing all of the constituant elements.
Figure 5:
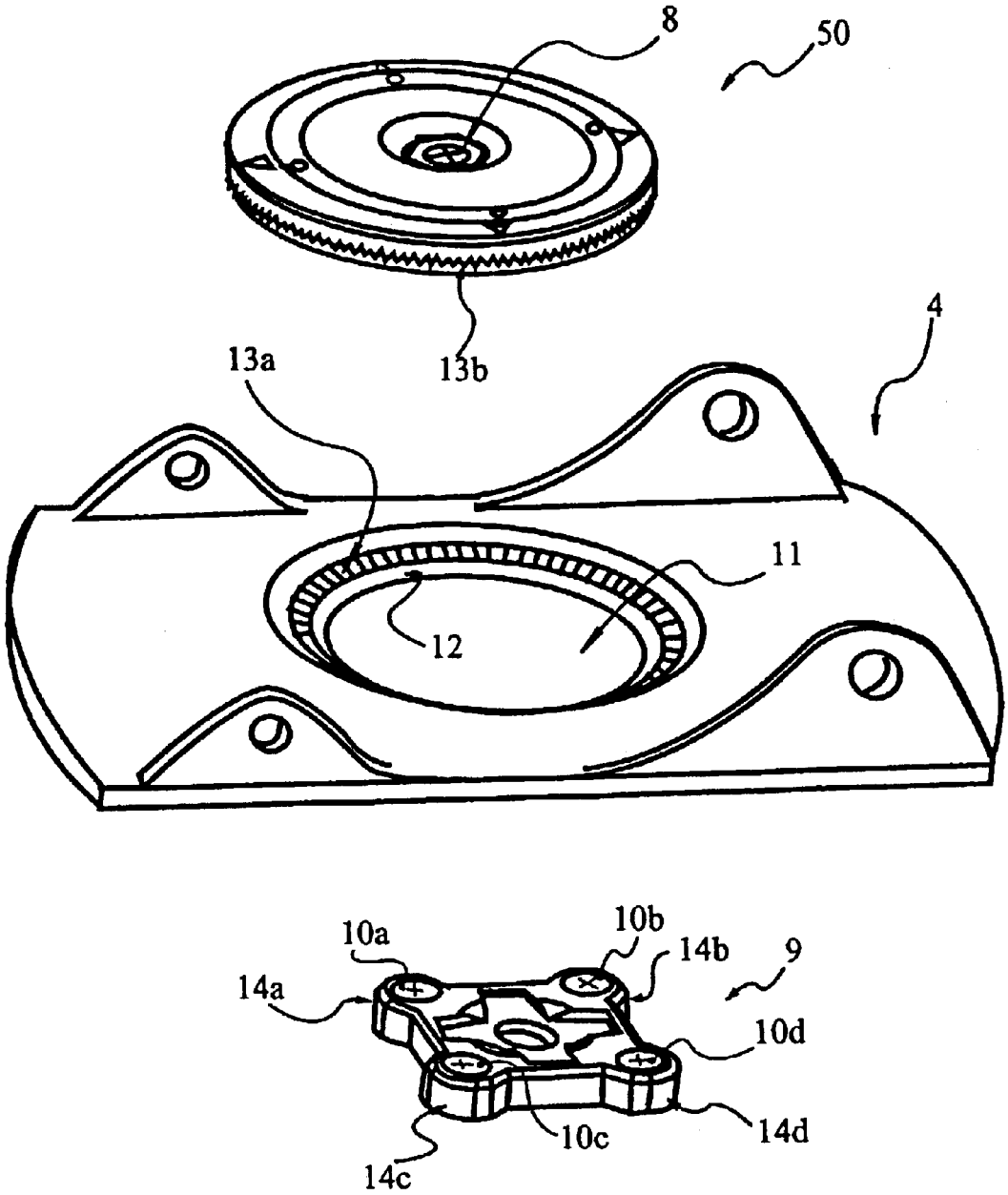
FIG. 5 is a view in perspective prior to assembly of the plate on the surf-board, with the retention sub-assembly being assembled.
Figure 6:
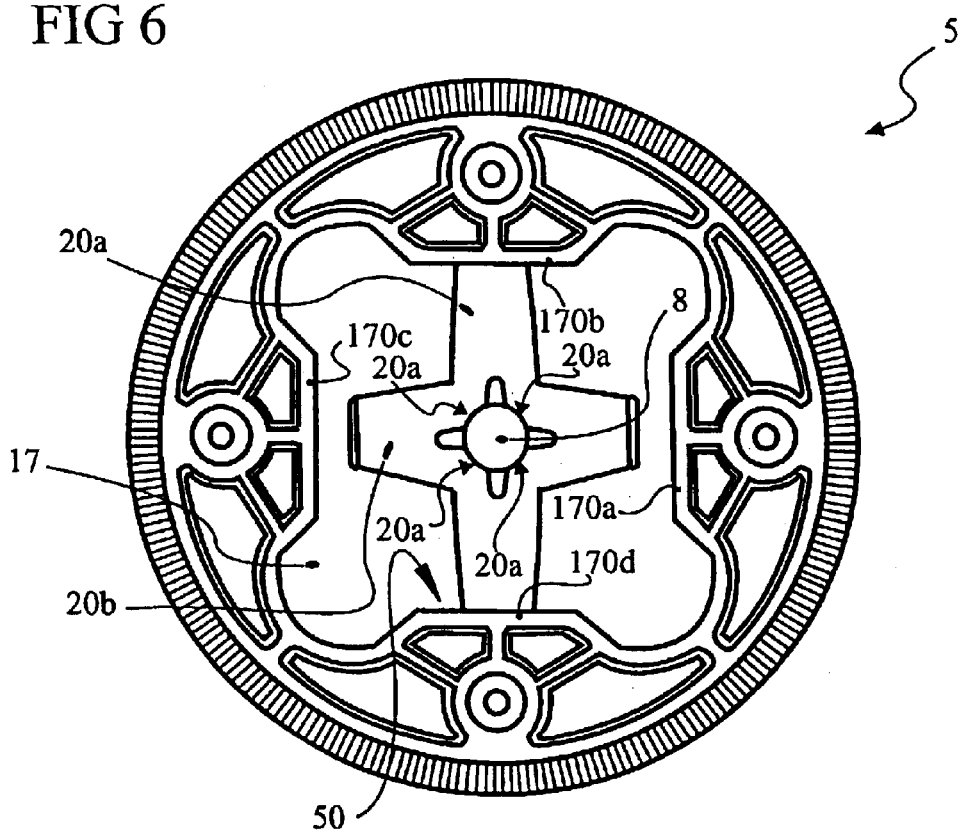
FIG. 6 is a view from below of the assembled retention sub-assembly.
Figure 7:
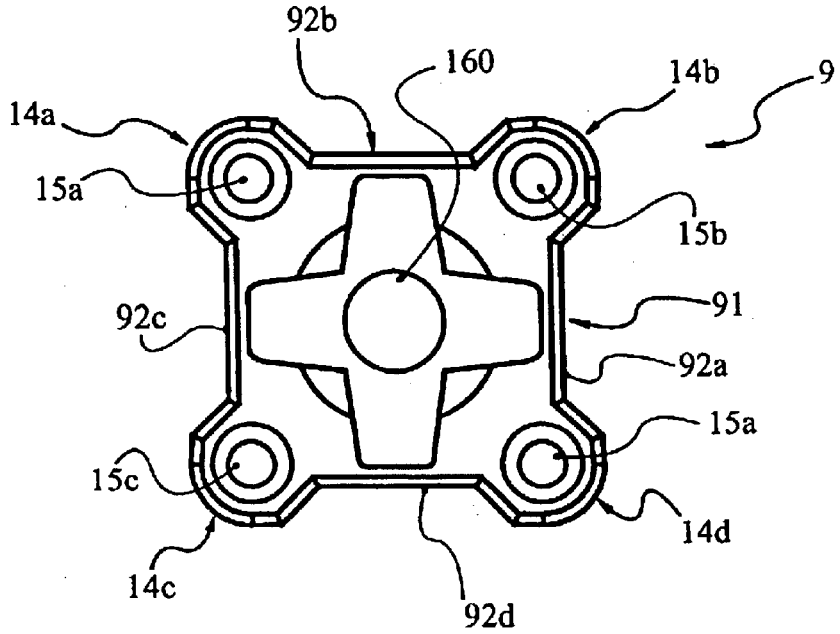
FIG. 7 is a view from above of the support base without the surf-board retention screw.

A gliding board (1) intended for the practice of surfing, with a vertical plane of general symmetry (P) comprising two retention devices (2*a*, 2*b*) also called fixations or bindings for retaining the two boots (30) of the user on said surf-board. The two retention devices are fixed to the upper surface (3) of the surf-board (1) in such fashion that their respective plane of general symmetry (T) is skewed in relation to the vertical plane of general symmetry (P) of the surf-board (1), such as illustrated in FIGS. 1, 2 and 3, but as is more particularly apparent in FIG. 1.

Consequently the plane of general symmetry (T) of the front binding (2*a*) forms with the plane of general symmetry (P) of the surf-board, an acute angle (A) open toward the front (AV) while the plane of general symmetry (T) of the rear binding (2*b*) forms, likewise, with the plane (P) an acute angle (B) open toward the front (AV).

Figure 1:
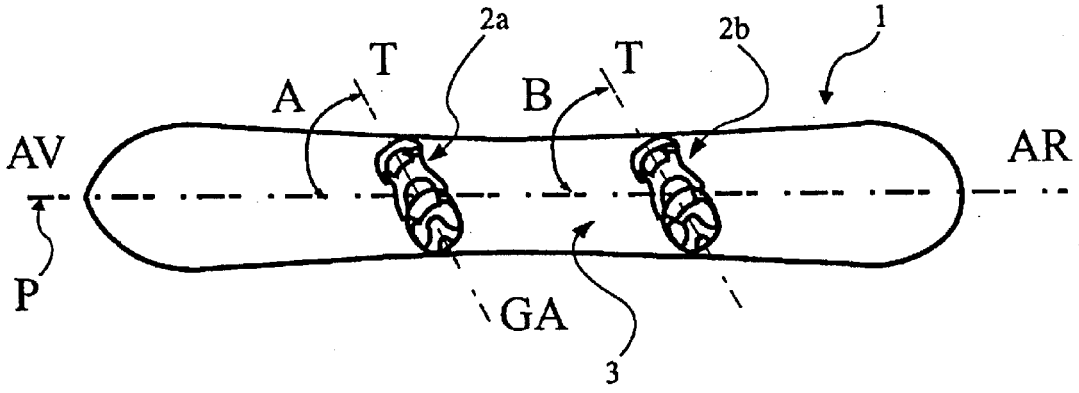
FIG. 1 is a view from above of a sliding board, such as a surf-board, equipped with the user's two boot retention devices.

The surf-board illustrated in FIG. 1 represents a retention arrangement for a right-handed person, i.e. the angles (A) and (B) are open toward the front (AV) and toward the right (DR). For a left-handed person, angles (A) and (B) would be open toward the front and toward the left (GA). It should also be noted that angle (A) of the front binding (@a) is different from angle (B) of the rear binding (2*b*).

A description follows of one of the boot retention devices which is identified by general reference (2) which comprises means permitting retention at and fixation to the surf-board in a selected angular position.

To that end, the retention device (2) is formed by a support base (4) or support plate on which the boot (30) of the user is fixed by any appropriate means, said plate being retained on the surf-board by its central portion, thanks to a central retention piece or circular pivot (5) and which appears in the shape of a vertical axis disk (X, X') permitting the user to regulate the angular position of the plate by rotation around the vertical axis (X, X'), then securing the locking in the chosen position.

According to the described specific embodiment, the plate (4) presents itself in the shape of an elongated plate, extending horizontally, on which the boot is retained, for example by a boot front retention organ (6), and a rear retention organ (7) retaining said boot at the level of the thrust of the foot.

The front retention organ (6) and the rear retention organ (7) are formed, according to the specific embodiment illustrated by way of example, by a semi-rigid strap, made, for example, of plastic material, beneficially comprising means of regulation in order to adapt same to the dimensions of the mass volume of said boot. Of course, any other retention means for the boot can also be provided, other than semi-rigid straps, as described, for example, in French Patent published under No. 2 742 997.

According to one characteristic of the invention, the pivot (5) is fixed in detachable fashion by a central screw (8) on a support base (9) fixed for example to surf-board (1) by four fixation screws (10*a*, 10*b*, 10*c*, 10*d*).

In addition, plate (4) comprises a central hole (11) intended to accept and cooperate with pivot (5). Said central hole comprises also a peripheral edge (12) comprising on its upwardly turned transverse surface a set of circular teeth (13*a*) formed by a succession of radial projections and cavities, the function of which will be explained.

The support base (9) realized, for example, of plastic material or of any other material, such as, for example, aluminum or any other, generally having a square shape, with each of its angles presenting an angular projection (14*a*, 14*b*, 14*c*, 14*d*) extending in diagonal fashion while each of the diagonal projections comprises a pass-through hole (15*a*, 15*b*, 15*c*, 15*d*) intended to receive the screws for attachment to the surf-board (10*a*, 10*b*, 10*c*, 10*d*).

The support base (9) is, in addition, pierced by a central hole (160) comprising threading (161) supported by a threaded nut (16).

The pivot is principally formed by a pivot body (5) having a generally circular shape and comprising a central encasement housing (17) in which the support base (9) is engaged. Also, said housing corresponds with respect to shape and dimensions to those of the support base (9), at least insofar as its periphery is concerned.

It should be noted that the pivot body (5) comprises a peripheral circular pivoting wall (18*a*) assuring, pivoting of the latter by means of cooperation with the corresponding circular wall (18*b*) of the central hole (11) of plate (4)

The vertical retention of the plate (4) is assured by the pivot, thanks to a peripheral edge (12*b*) projecting toward the exterior, intended to cooperate with the peripheral edge (12) of the central hole (11) of said plate.

The locking of the body of the pivot (5) on the support base (9) thus permits retention of the plate in upward direction by means of cooperation of the peripheral edge (12*b*) with the peripheral edge (12) of the central hole (11) but also locking in the chosen angular position at time of assembly. To that end, the transverse lower surface of the peripheral edge (12*b*) of the pivot comprises a circular set of teeth (13*b*) constituted by a succession of radial projections and cavities intended to cooperate with the corresponding set of circular teeth (13*a*) realized on the upper surface of the peripheral edge (12) of the central hole of the plate.

Figure 11:
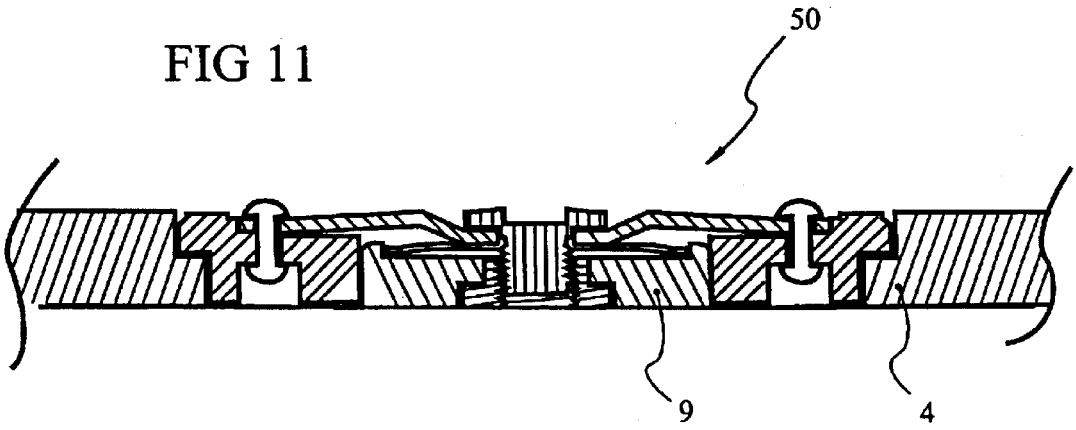

Cooperation of the set of teeth (13*b*) of pivot (5) with the set of teeth (13*a*) of plate (4) permits blocking the rotation of the support base when the pivot is fixed on the support base, as is illustrated in FIG. 11.

The center of the pivot comprises the central fixation screw (8) whose threaded stem (8*a*) projects towards the bottom (BA) in the central encasement housing (17) while said screw is integral with the pivot. In fact, the fixation screw (8) is captively retained by the pivot thanks to an elastic retention piece (20).

Said elastic retention piece (20) is realized, for example, with the aid of a thin steel sheet and presents a first transverse leg (20*a*) whose extremities are fixed at the pivot thanks to, for example, rivets (25) and a second transverse leg (20*b*) extending perpendicularly to the first leg. The central portion (20*c*) comprises a central hole (20*d*) edged by elastic laminae (20*e*) intended to become engaged by means of deformation in a circular groove (8*b*) of the stem (8*a*) of the screw (8). The latter is thus captively held by the pivot thanks to the elastic retention piece (20).

It should be added that the second transverse leg (20*b*) is shorter than the first leg and is curved in position of rest in order to elastically act upon the pivot in upward direction at time of disassembly.

One also notes that the pivot (5) comprises a decorative bonnet (22) enclosing the elastic retention piece which is sandwiched between the pivot body and the decorative bonnet. Said elastic retention piece (20) comprises a central hole (20*d*) while the head (8*d*) of the screw is visible above the bonnet, while its threaded stem (8*a*) projects in downward direction in the central encasement housing (17) over a distance (H1). It should be added that the decorative bonnet (22) is fixed to the pivot body (5), for example by rivets (25), while it retains, at the same time the elastic retention piece (20). It should also be added that the bonnet (22) comprises an axial hole (22*a*) permitting manipulation of the threaded stem (8*a*) of the screw (8).

Thus, the central retention screw (8) is integral with the pivot (5) while said pivot (5) with its screw (8) forms a solid piece set, constituting the retention sub-assembly (50), formed also in the specific embodiment by assembly with the pivot body of the elastic retention piece of the screw (20) and the decorative bonnet (22).

According to one characteristic of the invention, the length (H1) of the threaded stem (8*a*) of the central fixation screw (8) projecting toward the bottom in the central encasement housing (17) is equal to or less than the depth (H2) of said encasement housing (17).

FIGS. 8, 9, 10 and 11 are views in diametrical section of the pivot, the support base and the plate, illustrating the approach, the positioning and the fixation of the pivot (4) on the support base (9), previously fixed to the surfboard by its fixation screws (10*a*, 10*b*, 10*c*, 10*d*).

Figure 8:
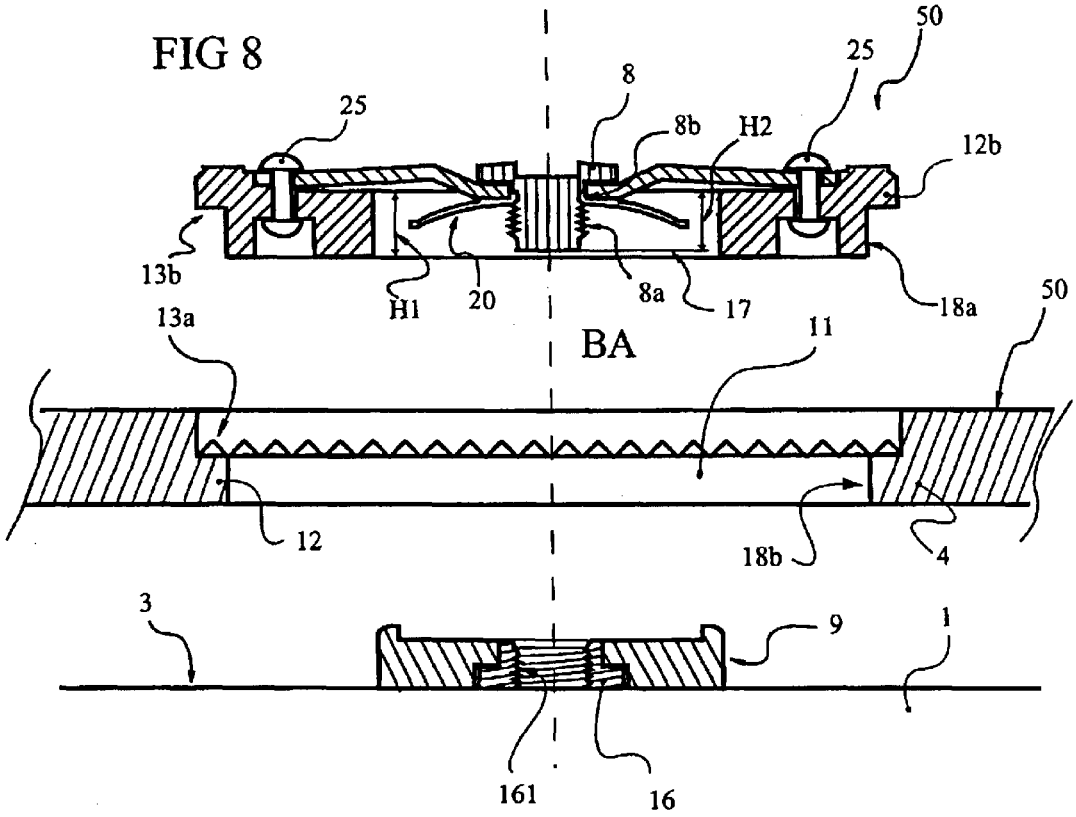
FIGS. 8, 9, 10 and 11 are larger scale, detailed diametrical section views representing the attachment of the plate on the surf-board.

FIG. 8 is a view indicating the different elements before assembly, namely:

the retention sub-assembly (50) with its central screw (8) its bonnet (22), its elastic retention plate (20) its pivot body (5)

the support plate (4)

the support base (9) and its threaded nut (16); the fixation screws (10*a*, 10*b*, 10*c*, 10*d*) are not represented.

Figure 9:
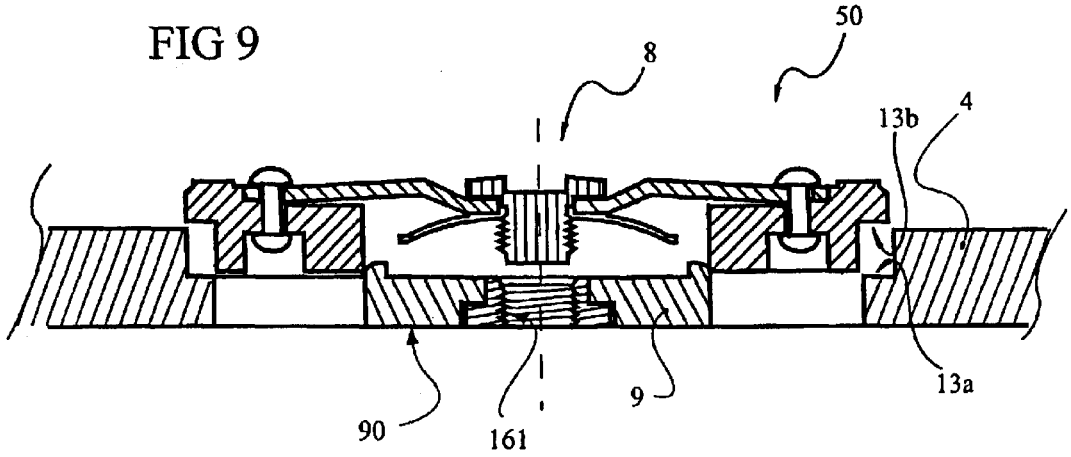

FIG. 9 is a view at the start of positioning the plate with its pivot. One notes with respect to said figure that the encasement of the support base (9) in the central encasement housing (17) takes place beforehand, so that the central fixation screw (8) does not touch and come into contact with the threading of the support base (9), that is to say beforehand, so that the threading (8*a*) of the screws (8) does not make contact with the threading (161) of the support base. This permits particularly precise and easy placement of the pivot on the support base, which is due to the fact that the central fixation screw (8) is integral with the pivot body (5) and due to the fact that the length (H1) of the threaded stem (8) of the central fixation screw (8) projecting in downward direction in the central encasement housing (17) is equal to or smaller than the depth (H2) of said encasement housing (17).

According to the preferred embodiment, one selects the solution according to which the length (H1) of the threaded stem (8*a*) of the central fixation screw (8) projecting in downward direction in the central encasement housing (17) is smaller than the depth (H2) of the encasement housing (17).

Figure 12:
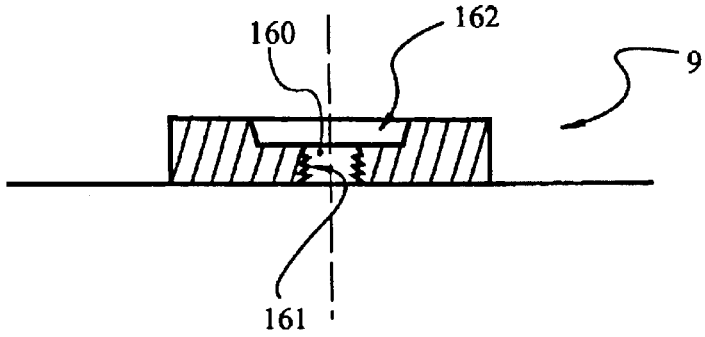
FIG. 12 is a transverse sectional view of a variation of the support base.

Of course, in the event that the length (H1) of the threaded stem (8*a*) of the central fixation screw (8) projecting in downward direction in the central encasement housing (17) would be equal to the depth (H2) of the encasement housing (17), provision is made, at the entry of the hole (160) of the support base (9), for an entry disengagement (162) of appropriate depth, such as shown in FIG. 12.

Figure 10:
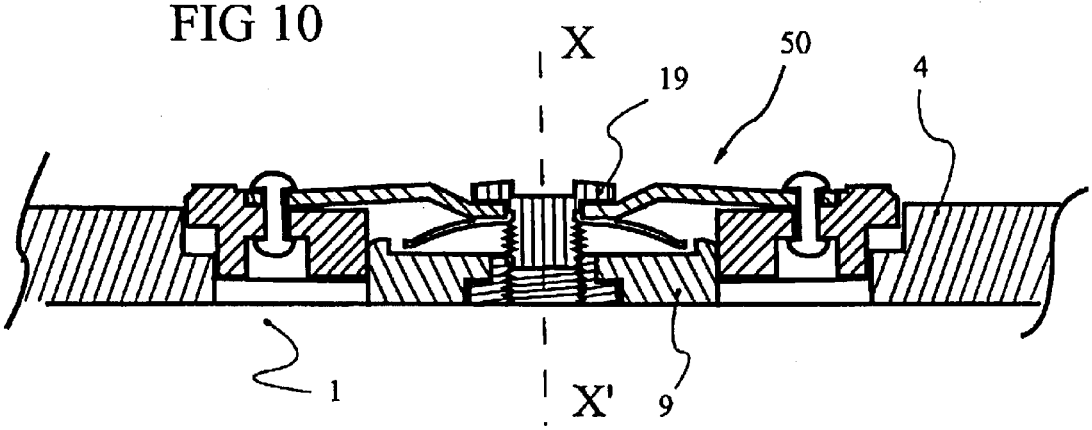

FIG. 10 shows a view while the pivot is being fixed on the support base. During said stage, the user can act without hesitation or reservation on the central screw (8) in order to fix the retention sub-assembly (50) on the support base (9) and thus guaranty retention of plate (4) and place the ensemble in the locked retention position illustrated in FIG. 11.

In the position of FIG. 10, the user can cause the support base (4) to pivot so as to place same in the chosen angular position, because the set of teeth (13*a*, 13*b*) is not yet engaged.

At time of locking, contact is established, in cooperation with the set of teeth (13*b*) of the pivot body, with the corresponding set of teeth (13*a*) of the plate. Of course, prior to complete fastening together, the user, by pivoting the plate around the vertical axis, positions same in the appropriate angular position. A position which he is able to modify at any moment by partially unscrewing the central fixation screw (8) until the respective set of teeth (13*a*, 13*b*) are released from cooperating with each other.

Figure 16:
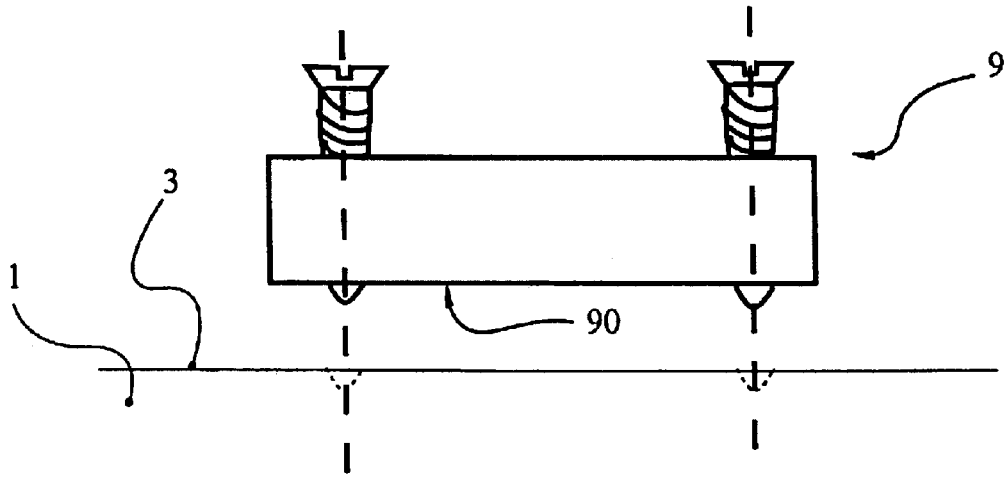
FIG. 16 is a lateral view of the support base of an improvement.

It goes without saying that the hole (160) of the support base (9) could be directly threaded without needing an independent nut, such as nut (16) represented earlier. In addition, the fixation screws (10*a*, 10*b*, 10*c*, 10*d*) could be pre-positioned on the support base, in other words, they could be put in place and retained in their respective holes (15*a*, 15*b*, 15*c*, 15*d*) in such manner so that only the tip does not project below the lower surface (90) as is illustrated in FIG. 16.

It should be noted that the general shape of the periphery (91) of the support base (9) and the general shape of the periphery (50) of the corresponding encasement housing (17) can be different from the illustrated shape. The essential feature being, having complementary shapes preventing the pivot body from displacement relative to the support base, in translation as well as in rotation. In the preferred illustrated embodiment, cooperation between the support base and the pivot body takes place by a succession of respectively protruding and recessed profiles (170*a*, 170*b*, 170*c*, 170*d*–92*a*, 92*b*, 92*c*, 92*d*).

The general shape of the support base (9), notably its periphery which is depicted as a general square shape, could, of course, have any other shape, such as triangular, oval, even round with recesses or protrusions, even a set of peripheral teeth cooperating with protrusions, recesses, a set of teeth realized in the encasement housing in order to block, in operating position, the rotation of the pivot body. It is pointed out that the elastic retention piece (20) assures retention of the central screw (8)—but it permits, thanks to the second transverse leg, action in upward direction on the sub-assembly (50) as soon as the user unscrews the central screw (8).

It should be added that the support base (9) has a thickness of more than 5 mm. and/or more than half of the thickness of the pivot body (5).

In order to proceed with the mounting of the pivot, it is sufficient for the operator to present the retention sub-assembly (50) above the support base, which was previously fixed to the surf-board in order for the support base (9) to rapidly and without impediment locate the encasement housing (17), since the operator needs only to turn the central screw (8) and thus achieve locking after having placed the plate (4) in the appropriate angular position.

In order to modify the angular position of the plate, the user or operator only has to unscrew the central screw (8) until the cooperation of the set of teeth is released, then have the thus released plate pivot around the vertical axis (X, X'), then proceed, once again, with locking by again turning the central screw.

Figure 17:
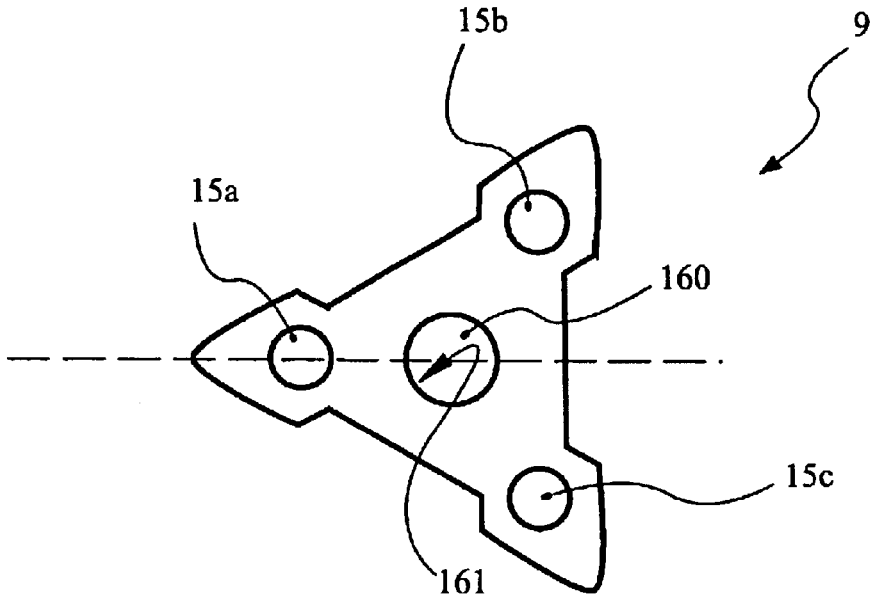
FIG. 17 is a view similar to FIG. 7, representing a variation of a specific embodiment.

It should likewise be noted that the chosen shape of the support base (9) was defined around a four screw assembly standard for surf-boards, but it goes without saying that the shape of the support base could be defined around a three screw assembly standard, as is illustrated, for example, in the specific embodiment shown in FIG. 17.

Figure 13:
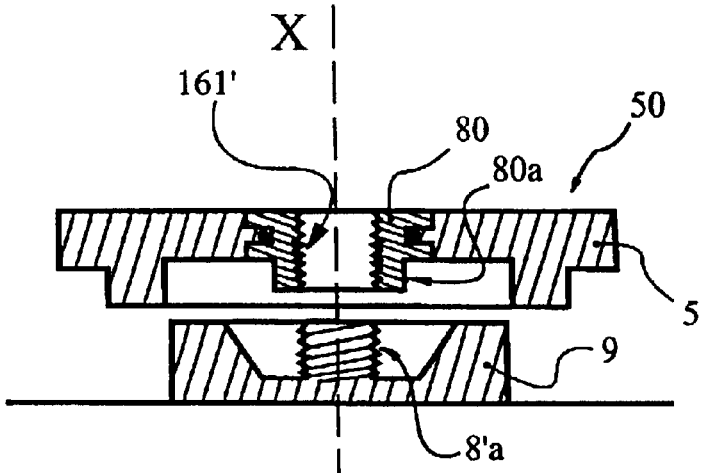
FIGS. 13, 14, 15 are views similar to FIGS. 8, 9, and 11, illustrating a variation of embodiment, with the support base not being shown.
Figure 14:
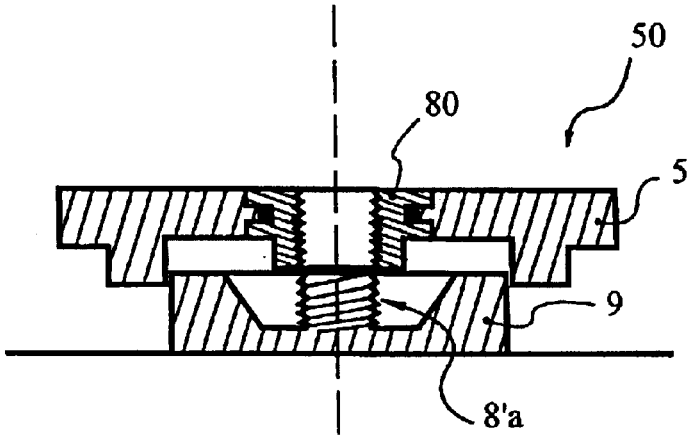
Figure 15:
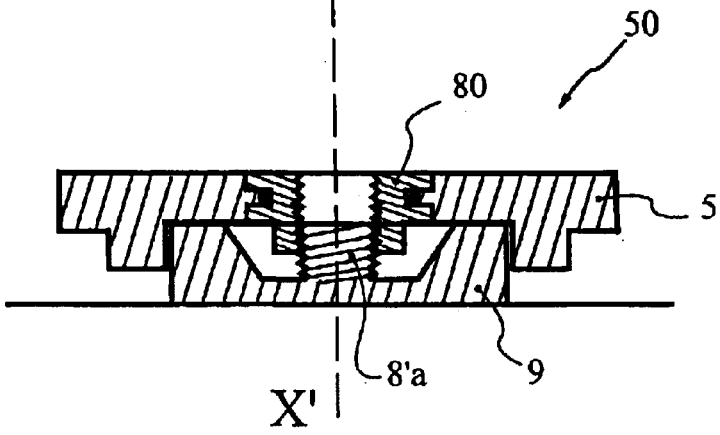

FIGS. 13, 14, 15 depict views which are similar to FIGS. 9, 10, 11, but without the plate, indicating an alternative embodiment. In this embodiment, the support base (9) includes a threaded stem (8'*a*). The sub-assembly (50) includes a corresponding nut (80), which is retained on the pivot body (5), and which includes threading on a threaded portion (80*a*).

It should be added to the preceding that the shape of the support base (9) presents the benefit of permitting the user and specifically the assembler to choose several orientation positions of the pivot body (5).

Needless to say, the invention is not limited to the embodiments described and represented by way of example, but it also includes all equivalent techniques, as well as their combinations.

What is claimed is:

1. A retention device for retaining a boot on a sliding board comprising:

a plate equipped with retention means for retaining the boot and having a central hole;

a pivot body secured in the central hole of the plate to retain the plate at least vertically;

a support base attached to the sliding board;

a single screw and nut combination centrally connecting the pivot body and the support base, the single screw and nut combination being a sole interconnection between the pivot body and the support base;

the pivot body including a central encasement housing, open toward the bottom, in which is engaged the support base; and one of a threaded stem of a screw portion or a threaded nut portion of the single screw and nut combination projecting downward from the pivot body into the central encasement housing, the length of the threaded stem of the screw or nut portion being equal to or less than the depth of the encasement housing.

2. A retention device for retaining a boot on a sliding board comprising:

a plate including a central hole, said central hole comprising, in addition, a peripheral edge, whose transverse surface turned in upward direction comprises a circular set of teeth formed by a succession of radial projections and recesses;

a pivot body accented in and cooperating with the central hole of the plate, said pivot body including a succession of radial projections and recesses, on a lower transverse surface of a peripheral edge for cooperating with the circular set of teeth, and one of a central screw and a central nut;

a support base attached to the sliding board, the support base including threading intended to cooperate with a threaded stem of the central screw or nut of the pivot body;

the pivot body including a central well, open toward the bottom, which receives the support base; and the threaded stem of the central screw or the threaded portion of the central nut projecting downward in the central well, the length of the threaded stem being equal or less than the depth of the well.

3. The retention device according to claim 1, wherein one of the screw portion and the nut portion is captively retained by the pivot body.

4. The retention device according to claim 3, wherein the screw portion is captively retained by the pivot body by an elastic retention piece.

5. The retention device according to claim 1, wherein the support base has a thickness of more than 5 mm.

6. The retention device according to claim 5, wherein the support base has a thickness of more than half of the thickness of the pivot body.

7. The retention device according to claim 1, wherein the support base has a generally square shape, each of its corners presenting a projection extending diagonally, while the encasement housing has a complementary shape, preventing the pivot body from displacement during translation and rotation.

8. The retention device according to claim 7, wherein each of the diagonal projections includes a hole intended to receive a sliding-board retention screw.

9. The retention device according to claim 8, wherein the sliding-board retention screws are positioned in holes.

10. A sliding-board intended to be equipped with retention devices for a boot according to claim 1, comprising two support bases.

11. A snowboard comprising:

a sliding board for sliding on snow;

a plate equipped with retention means for retaining an associated boot;

a pivot body located in a central hole of the plate, which retains the plate on the board, said pivot body including:

a downwardly open housing, and one of a single central screw and a single central nut;

a support base attached to the sliding board, the support base including a threaded configuration for engaging with a threaded portion of the central screw or the central nut of the pivot body, the support base being non-rotatably retained within the downwardly open housing of the pivot body, the pivot body and the support base being connected solely by the single central screw or nut and the threaded portion, such that the plate is retained on the board by the single screw or nut.

12. The snowboard of claim 11, wherein the threaded stem of the central screw or nut projects downward in the housing, a length of the threaded stem of the central screw or nut being no more than a depth of the downwardly open housing.

* * * * *